US011892167B2

(12) United States Patent
Levitsky

(10) Patent No.: US 11,892,167 B2
(45) Date of Patent: Feb. 6, 2024

(54) ATOMIZER FOR GAS TURBINE ENGINE

(71) Applicant: Turbogen Ltd., Ramat Gan (IL)

(72) Inventor: Michael Levitsky, Beersheva (IL)

(73) Assignee: Turbogen Ltd., Ramat Gan (IL)

( * ) Notice: Subject to any disclaimer, the term of this patent is extended or adjusted under 35 U.S.C. 154(b) by 0 days.

(21) Appl. No.: 17/791,232

(22) PCT Filed: Jan. 7, 2021

(86) PCT No.: PCT/IB2021/050087
§ 371 (c)(1),
(2) Date: Jul. 7, 2022

(87) PCT Pub. No.: WO2021/148896
PCT Pub. Date: Jul. 29, 2021

(65) Prior Publication Data

US 2022/0364731 A1 Nov. 17, 2022

Related U.S. Application Data

(60) Provisional application No. 62/964,146, filed on Jan. 22, 2020.

(51) Int. Cl.
*F23R 3/12* (2006.01)
*F23R 3/28* (2006.01)
*F23R 3/30* (2006.01)

(52) U.S. Cl.
CPC ..... *F23R 3/286* (2013.01); *F23R 3/12* (2013.01); *F23R 3/30* (2013.01)

(58) Field of Classification Search
CPC ..... F23R 3/28; F23R 3/286; F23R 3/30
See application file for complete search history.

(56) References Cited

U.S. PATENT DOCUMENTS 3,811,278 A * 5/1974 Taylor ..... F23R 3/28 239/404
3,853,273 A * 12/1974 Bahr ..... F23R 3/14 239/404
4,078,377 A * 3/1978 Owens ..... F02C 3/14 60/39.23
6,405,523 B1 * 6/2002 Foust ..... F23R 3/14 60/776
10,184,665 B2 * 1/2019 Benjamin ..... F02C 7/22
2012/0228405 A1 * 9/2012 Buelow ..... F23R 3/343 239/463

(Continued)

*Primary Examiner* — William H Rodriguez
(74) *Attorney, Agent, or Firm* — Mark M. Friedman

(57) ABSTRACT

An atomizer provides a high-quality fuel-air mixture to a gas turbine engine, by combining air input from an engine compressor and fuel input from a single low-pressure fuel supply pump. The atomizer includes an atomizer body, a main vortex chamber, a secondary vortex chamber for improving quality of the fuel-air mixture, and a fuel sleeve providing fuel to the secondary vortex chamber. The main vortex chamber includes a main outlet nozzle in fluid communication with a combustion chamber inlet of the gas turbine engine. The secondary vortex chamber includes a secondary outlet nozzle in fluid communication with the main vortex chamber. The fuel sleeve has a blind channel with a longitudinal axis and a fuel tip. The same atomizer may be used for startup mode and for all operational modes of the gas turbine engine.

12 Claims, 6 Drawing Sheets

(56) References Cited

U.S. PATENT DOCUMENTS

| | | | | |
|---|---|---|---|---|
| 2014/0338337 | A1* | 11/2014 | Prociw | F23R 3/10 60/737 |
| 2017/0298829 | A1* | 10/2017 | Ozem | F02C 7/222 |
| 2019/0024899 | A1* | 1/2019 | Patel | F23R 3/346 |

* cited by examiner

ATOMIZER FOR GAS TURBINE ENGINE

CROSS-REFERENCE TO RELATED APPLICATIONS

This application claims the benefit of U.S. provisional patent application Ser. No. 62/964,146, filed Jan. 22, 2020, by the present inventor, which is incorporated by reference in its entirety herein.

FIELD OF THE INVENTION

The invention relates to atomizers for gas turbine engines.

BACKGROUND

The quality of the fuel-air mixture injected into the combustion chamber of a gas turbine is crucial in determining the combustion efficiency and the level of emission products in the exhaust flow of a gas turbine, over a variety of starting and operating conditions. Generally, the fuel must be atomized so that the distribution of fuel droplet sizes is below a given diameter size, which is typically about 30 microns. When the droplet sizes are overly large, or when the fuel-air mixture is overly rich, ignition of the mixture is difficult, and burning of the fuel is inefficient and incomplete.

Air blast nozzles are used in a fuel atomizer in order to shear the fuel into droplets, for a given nozzle pressure drop. The nozzle typically has an annulus for high-speed air flow, which provides the energy needed to atomize the fuel stream into small droplets. Fuel injectors are typically used to facilitate fuel ignition in the combustor. Aerodynamic injection is used to vaporize the fuel before it enters into the flame zone. Aerodynamic injectors generally include whirling, or swirled vanes through which air from a compressor is introduced. Also, flow dividers, multiple fuel supply lines, and fuel injectors with multiple orifices are used to provide the different fuel-air mixtures needed for different modes of turbine starting and operation.

In some cases, a primary nozzle orifice is used to provide a finely atomized fuel spray that can be ignited for engine start. After combustion starts and the engine speed increases, secondary nozzle orifices are opened to increase fuel flow.

One approach for adapting the fuel-air mixture to various modes of starting and operating a gas turbine engine is to use a combustion chamber having a two-stage combustion chamber. For example, U.S. Pat. No. 4,603,548 to Y. Ishibashi et al., issued Aug. 5, 1986, and entitled "Method of Supplying Fuel into Gas Turbine Combustor," discloses a fuel supply method for a gas turbine combustor having first and second stage combustion chambers. The method comprises supplying the fuel from only a first stage fuel supply from the start of the gas turbine until its low output range so as to operate only the first stage combustion chamber, and supplying the fuel from both first and second stage fuel supplies in a high output range of the gas turbine including its maximum output so as to operate both first and second stage combustion chambers.

As another example, U.S. Pat. No. 4,683,715 to N. Iizuka, issued Aug. 4, 1987, and entitled "Method of Starting Gas Turbine Plant," discloses a method of starting a gas turbine plant, having at least one combustor including a primary combustion chamber into which primary fuel nozzles open and a secondary combustion chamber into which secondary fuel nozzles open, a compressor for supplying the combustor with compressed combustion air, and a gas turbine driven by the combustion gas generated in the combustor and adapted to drive a load such as an electric power generator.

Yet another approach is to use multiple injectors and/or a fuel flow rate control unit. For example, U.S. Pat. No. 5,311,742 to A. Izumi et al., issued May 17, 1994, and entitled "Gas Turbine Combustor with Nozzle Pressure Ratio Control," teaches a gas turbine combustor for a gas turbine power plant having a combustion liner connected to a turbine and provided with a main fuel nozzle assembly and a sub-fuel nozzle assembly for jetting fuel to an inside of the combustion liner through nozzle holes, a base fuel supply line, a main fuel line for supplying a fuel to the main nozzle assembly for premixing an air with the fuel jetted through the nozzle hole for carrying out a lean burning in the combustion liner, and a plurality of sub-fuel lines for supplying the fuel to the sub-fuel nozzle assembly for mixing the fuel with a combustion air for carrying out a diffusion burning in the combustion liner.

U.S. Pat. No. 564,753 to J. Richardson, issued Jul. 15, 1997, and entitled "Gas Turbine Engine Fuel Injection Apparatus," discloses an apparatus having a central core which is provided with two fuel supply ducts. The first fuel supply duct supplies fuel for atomization in a swirling airstream; the atomized fuel being subsequently thoroughly mixed with air in an axially elongate mixing duct. The second fuel supply duct supplies fuel to the downstream end of the core where the fuel is atomized by an air flow through a duct surrounding the core before being exhausted from the core downstream end.

Aerodynamic type injectors create air-fuel pre-mixtures using whirling, or swirled vanes through which air from the engine compressor is introduced. For example, U.S. Pat. No. 6,886,342 to H. Alkabie, issued May 3, 2005, and entitled "Vortex Fuel Nozzle to Reduce Noise Levels and Improve Mixing," teaches a fuel nozzle with a ring of fuel spray orifices directing fuel jets at a fuel vortex generator having a fuel deflecting surface disposed downstream a distance from each fuel spray orifice.

US Patent Publication Number US2017/184307A1, by B. Patel et al., dated Jun. 29, 2017, and entitled "Fuel Injector for Fuel Spray Nozzle," teaches a fuel injector for a fuel spray nozzle of a gas turbine engine combustor including an angular lip axially projecting into an upstream section of an annular passage to guide a fuel layer vortex to flow along a radially outer passage wall of the annular passage and to guide an air layer vortex to fill into and pass through an annular space between the fuel layer vortex and a radially-inner passage wall of the annular passage.

For high quality fuel atomization, multiple injectors may be used, each of which is equipped with an air swirler. For example, U.S. Pat. No. 5,816,050 to A. Sjunnesson et al., issued Oct. 6, 1998, and entitled "Low-Emission Combustion Chamber for Gas Turbine Engines." teaches a low-emission combustion chamber for gas turbine engines having an outer casing with an upstream end wall with a pilot fuel injector, a first flow swirler, an igniting member for initiating a stable diffusion flame in a pilot zone, at least one second coaxial swirler, main fuel injectors, secondary air inlets, and a main combustion zone.

In some cases, for stable combustion, more than two fuel inputs are used. For example, U.S. Pat. No. 5,660,045, to K. Ito et al., issued Aug. 26, 1997, and entitled "Gas Turbine Combustor and Gas Turbine," discloses a gas turbine combustor which is able to effect stable combustion in a wide range of fuel flow rate. A burner is provided with two fuel nozzles. When a fuel flow rate is small, diffusion flame is formed with fuel supplied from a first nozzle with a ringshaped flame stabilizer. Next, fuel is supplied from a second nozzle to mix with air, reach to the flame stabilizer and be held by the diffusion flame already formed, whereby stable premixed flames are formed in the flame stabilizer from a range of low fuel air ratio. Further, when flame is propagated from a first burner to a second burner, a fuel air ratio at the outer periphery side of the first burner is locally raised by the fuel supplied from the first nozzle, whereby the combustion stability can be raised in a wide range of fuel flow rate and propagation of flame to adjacent burners becomes easy.

For high altitude starting, it is difficult to achieve high quality atomization under conditions of low airflow and low air pressure drop. Under these conditions, the flow is mostly laminar and lacks sufficient energy to physically atomize the fuel. One approach is to use starting fuel injectors that operate in pressure atomization mode, and main fuel injectors that operate in air blast mode. Highly pressurized air provides the energy needed to atomize the fuel flowing through the fuel injectors. Generally, a high-pressure pump is then required for reliable starting and continuous operation of the gas turbine, and this adds cost, complexity, and weight to the overall turbine system.

U.S. Pat. No. 3,657,885 to E. Bader, issued Apr. 25, 1972, and entitled "Fuel Nozzle for Gas Turbine Engines," discloses a fuel nozzle for gas turbine engines, which is provided with fuel metering orifices for emitting fuel jets and in which compressor air to be admixed to the fuel, is drawn in by the fuel jets by way of apertures arranged in a cylindrical nozzle housing and located in front of an upstream flame tube wall of the flame tube associated with the combustion chamber.

U.S. Pat. No. 4,342,198 to J. D. Willis, dated Aug. 3, 1982, and entitled "Gas Turbine Engine Fuel Injectors," discloses a gas turbine engine fuel injector having distinct and separate flow paths for liquid and gaseous fuel which each terminate in outlets of decreasing cross-sectional area in order to prevent combustion products from the flame tube or tubes of the engine from flowing back into the injector, the separate fuel flow paths preventing fuel from migrating from one path to the other.

U.S. Pat. No. 6,363,724 to W. T. Bechtel, dated Apr. 2, 2002, and entitled "Gas Only Nozzle Fuel Tip," teaches a diffusion flame nozzle gas tip which converts a dual fuel nozzle to a gas only nozzle. The nozzle tip diverts compressor discharge air from the passage feeding the diffusion nozzle air swirl vanes to a region vacated by removal of the dual fuel components, so that the diverted compressor discharge air can flow to and through effusion holes in the end cap plate of the nozzle tip. The atomizers of the prior art have several significant drawbacks. For example, in some prior-art atomizers, fuel is introduced into a peripheral zone of rotating air, where the tangential air velocity is less than the maximum possible value for a given air supply pressure. This reduces the difference between air and fuel velocities in their zone of interaction, which adversely affects the quality of the resulting fuel-air mixture.

Another drawback in some prior-art atomizers is that fuel is injected into an air chamber inlet area where air swirls are installed, due to the significant air pressure in the inlet cavity of the combustion chamber. As a result, a high fuel injection pressure is needed in order to atomize the fuel and to maintain a required pressure differential between the liquid pressure and the air pressure at the fuel inlet point. The need for a high fuel injection pressure is incompatible with the use of a low-pressure fuel pump.

A further drawback in the prior art is that some atomizers incorporate tilted blades to swirl the air flow, which complicates the design, increases the cost of manufacture, and reduces reliability of the atomizer.

SUMMARY OF THE INVENTION

The present invention eliminates the drawbacks of the prior art by providing an atomizer for gas turbine engines which produces a high-quality atomized fuel-air mixture under conditions of a small air pressure, a small airflow rate, and a small fuel injection pressure. The fuel injection pressure may even be near zero, as its value does not influence the fuel atomization quality. For these reasons, the atomizer of the invention is able to utilize a single low-pressure fuel pump and an air inlet from an engine compressor, both for engine start-up and for all operational modes of the gas turbine engine.

According to one aspect of the presently disclosed subject matter, an atomizer, for providing a high-quality fuel-air mixture to a gas turbine engine, receives air input from an engine compressor and fuel input from a low-pressure fuel pump. The atomizer includes an atomizer body, a main vortex chamber, a secondary vortex chamber for improving a quality of the fuel-air mixture, and a fuel sleeve providing fuel to the secondary vortex chamber. The main vortex chamber includes a main outlet nozzle in fluid communication with a combustion chamber inlet of the gas turbine engine; the secondary vortex chamber includes a secondary outlet nozzle in fluid communication with the main vortex chamber, and the fuel sleeve has a blind channel with a longitudinal axis and a fuel tip.

According to some aspects, the atomizer is configured to provide an atomized fuel-air mixture to the gas turbine engine, both for engine startup and for all operational modes of the engine.

According to some aspects, the main vortex chamber includes one or more tangential channels.

According to some aspects, the secondary vortex chamber includes one or more tangential orifices.

According to some aspects, the fuel sleeve further includes at least one radial orifice and/or at least one fuel nozzle.

According to some aspects, the secondary vortex chamber and the fuel sleeve are coaxial.

According to some aspects, a position of the main and secondary vortex chambers with respect to the fuel sleeve is fixed by a threaded nut.

According to some aspects, the atomizer further includes an air cavity and grooves on a surface of the main vortex chamber which supply air to the air cavity.

According to some aspects, the atomizer also includes an airflow tip and/or an air collector.

According to some aspects, a ratio of a mass flow rate of the air input to a mass flow rate of the fuel input has a value in a range of two to six.

According to some aspects, an atomization quality, as determined by a distribution of fuel droplet diameters in the fuel-air mixture, is substantially the same for engine startup and for all operational modes of the engine.

According to some aspects, a ratio of a secondary outlet nozzle outer radius ($r_b^a$) to a main output nozzle radius ($r_n$) is greater than or equal to the square root of a nozzle threshold parameter ($1-\varphi$).

According to some aspects, a ratio of a fuel sleeve outer radius ($r_b$) to a secondary outlet nozzle radius ($r_n^a$) is greater than or equal to the square root of a nozzle threshold parameter ($1-\varphi$).

BRIEF DESCRIPTION OF THE DRAWINGS

The invention is described herein, by way of example only, with reference to the accompanying drawings, wherein.

DETAILED DESCRIPTION

The invention is an atomizer for providing a high-quality fuel-air mixture to a gas turbine engine, for use during engine start-up and during all operational modes of the engine. The principles and practical use of the invention may be better understood with reference to the drawings and the accompanying description.

Figure 1:
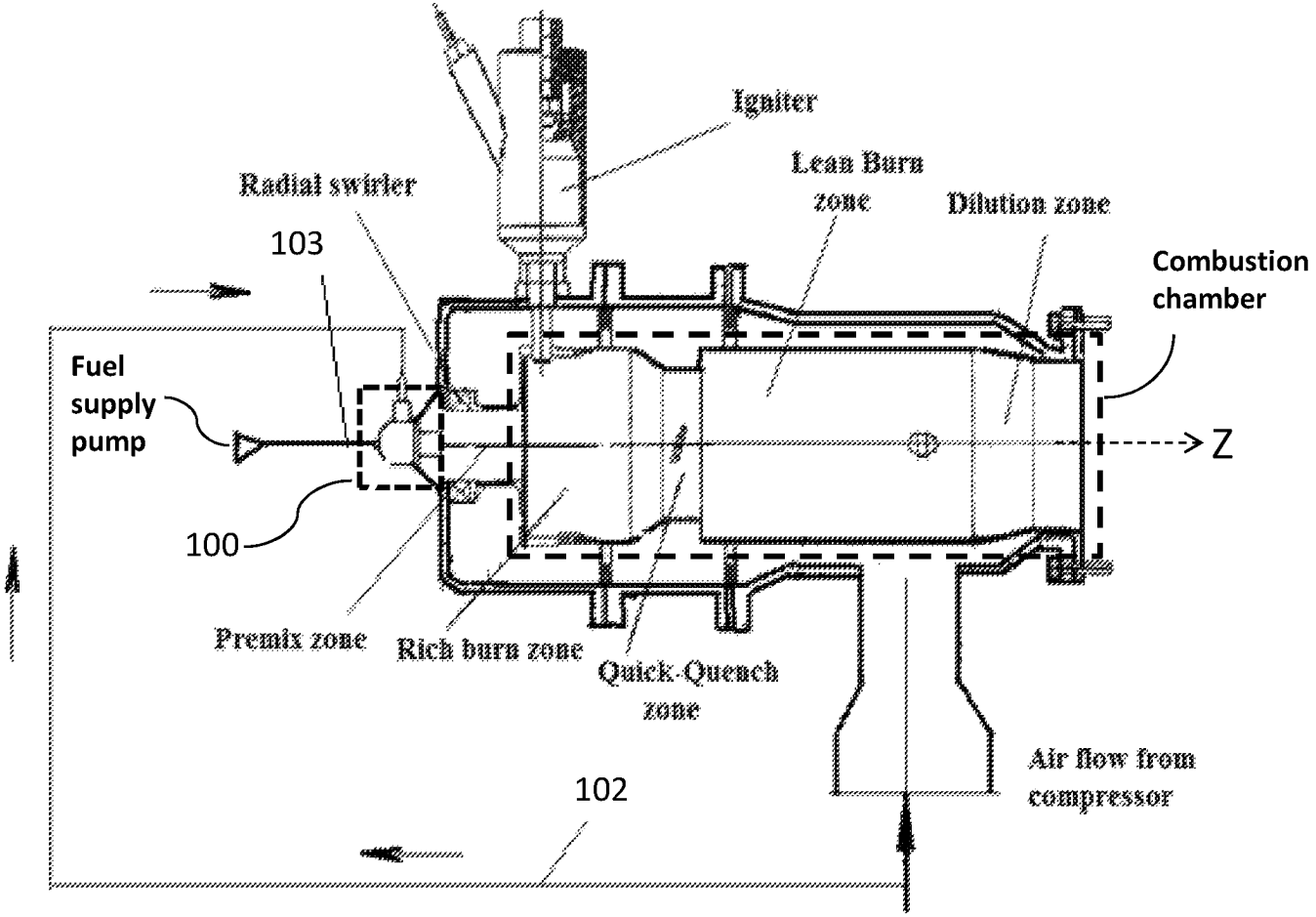
FIG. 1 is a conceptual drawing of air and fuel flow into an atomizer, according to the principles of the present invention.

FIG. 1 shows a conceptual drawing of air and fuel flow into an atomizer 100, according to the principles of the present invention. Fuel enters atomizer 100 via fuel line 103 which receives fuel from a fuel supply pump, which provides fuel at a low pressure, for example in a pressure range of 2 to 10 bar. Air enters atomizer 100 via air line 102, which receives air from a compressor of the gas turbine engine (not shown). The arrows indicate the direction of airflow. The atomizer 100 mixes air and fuel to form a fuel-air mixture which flows in the axial Z-direction into a combustion chamber of the engine. Typically, the ratio of air mass flow rate to fuel mass flow rate is in a range of two to six.

Figure 2:
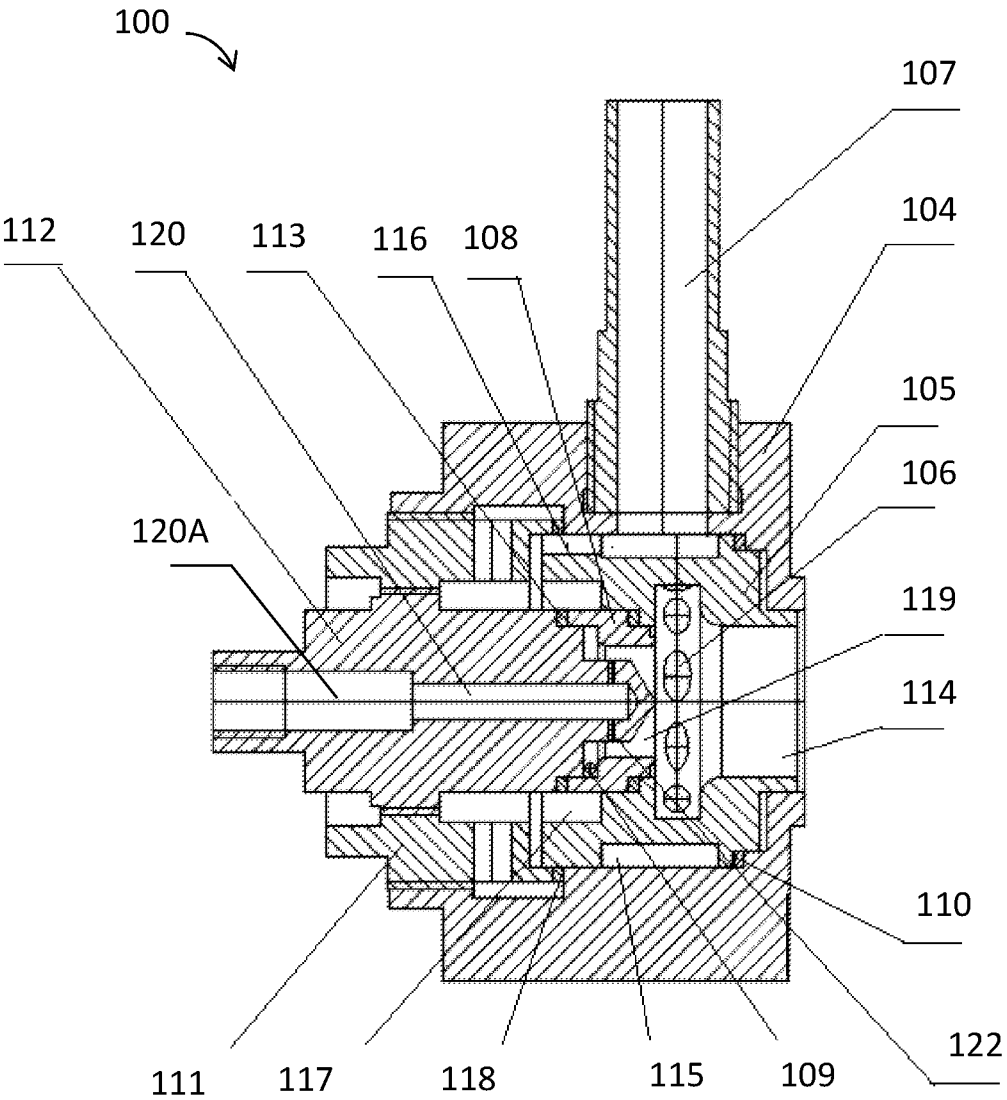
FIG. 2 is a cross-sectional drawing of an atomizer according to an embodiment of the present invention.

FIG. 2 shows a cross-sectional drawing of atomizer 100 according to an embodiment of the present invention. Two-phase fuel-air mixtures are formed in a main vortex chamber 105 having a main outlet nozzle 114 and in a secondary vortex chamber 108 having a secondary outlet nozzle 119, respectively. Both outlet nozzles provide fuel-air mixtures which flow into a combustion chamber of the turbine engine.

An airflow tip 107 introduces an airflow which passes through an opening in atomizer body 104 and into the main and secondary vortex chambers. Air enters into main vortex chamber 105 through tangential channels 106 and into secondary vortex chamber 108 through tangential orifices 109. The positions of the two vortex chambers are fixed relative to the atomizer body 104 by means of compressive force applied to sealing rings 113 and 110.

A fuel sleeve 112 receives fuel from fuel line 103 (shown in FIG. 1) and supplies it to the secondary vortex chamber. The fuel sleeve 112 contains a blind channel 120, having a longitudinal axis 120A, and a fuel tip 122. The fuel sleeve is held in place by a threaded nut 111. In the exemplary embodiment of FIG. 2, the fuel sleeve 112 and the secondary vortex chamber 108 are coaxial.

Air collector 115 supplies air to tangential channels 106. Grooves 116 on the surface of the main vortex chamber, on the side facing the threaded nut 111, supply air to air cavity 117, which is located between the main vortex chamber 105 and the threaded nut 111. Air cavity 117 is sealed by O-ring 118.

Figure 3A:
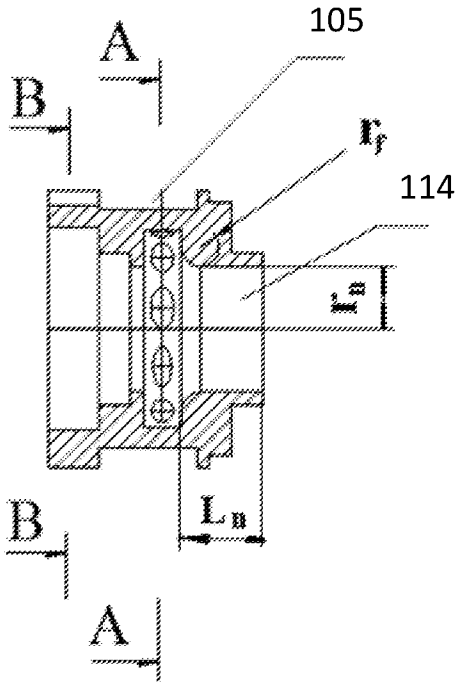
FIG. 3A, FIG. 3B, and FIG. 3C are cross-sectional drawings of the main vortex chamber of the atomizer embodiment of FIG. 2.
Figure 3B:
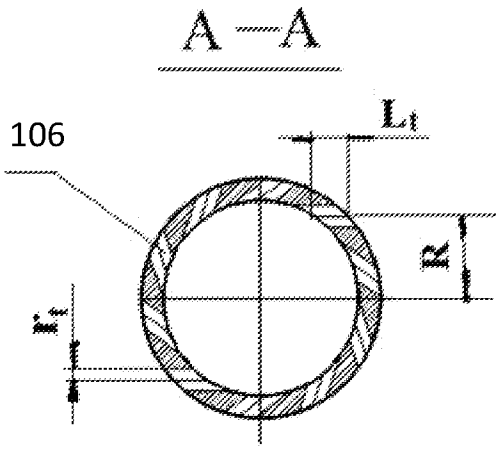
Figure 3C:
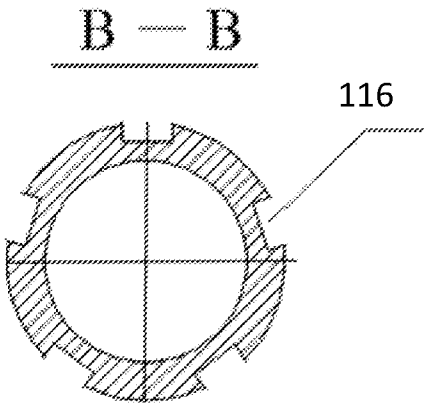

FIGS. 3A, 3B, and 3C show exemplary cross-sectional drawings of the main vortex chamber of the atomizer shown in FIG. 2, together with relevant geometric parameters. The main outlet nozzle 114 of the main vortex chamber 105 provides outflow of the fuel-air mixture into a premix zone of the combustion chamber. FIG. 3A shows a detail of the main outlet nozzle 114; FIG. 3B shows a detail of the tangential channels 106; and FIG. 3C shows a detail of the grooves 116.

Figure 4B:
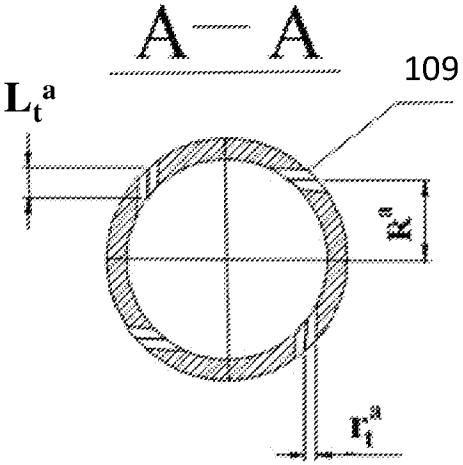
FIG. 4A and FIG. 4B are cross-sectional drawings of the secondary vortex chamber of the atomizer embodiment of FIG. 2.
Figure 4A:
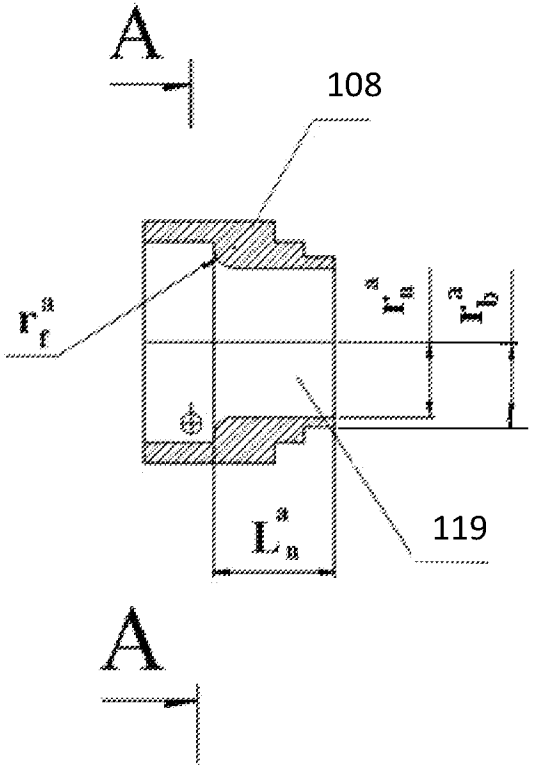

FIGS. 4A and 4B show exemplary cross-sectional drawings of the secondary vortex chamber 108 of the atomizer shown in FIG. 2, together with relevant geometric parameters. FIG. 4A shows a detail of the secondary outlet nozzle 119 in the secondary vortex chamber 108; and FIG. 4B shows a detail of tangential orifices 109.

Figure 5B:
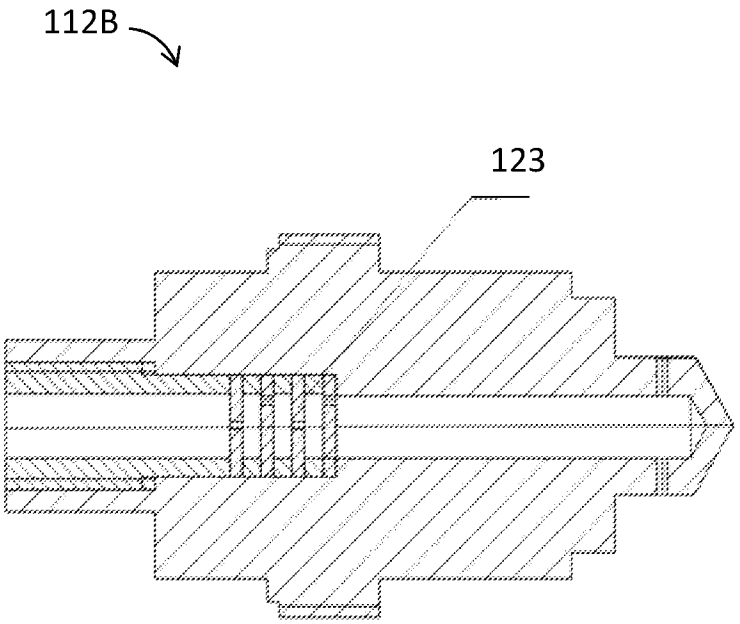
FIG. 5A and FIG. 5B are cross-sectional drawings of two alternative embodiments of a fuel sleeve of the atomizer, according to the principles of the invention.
Figure 5A:
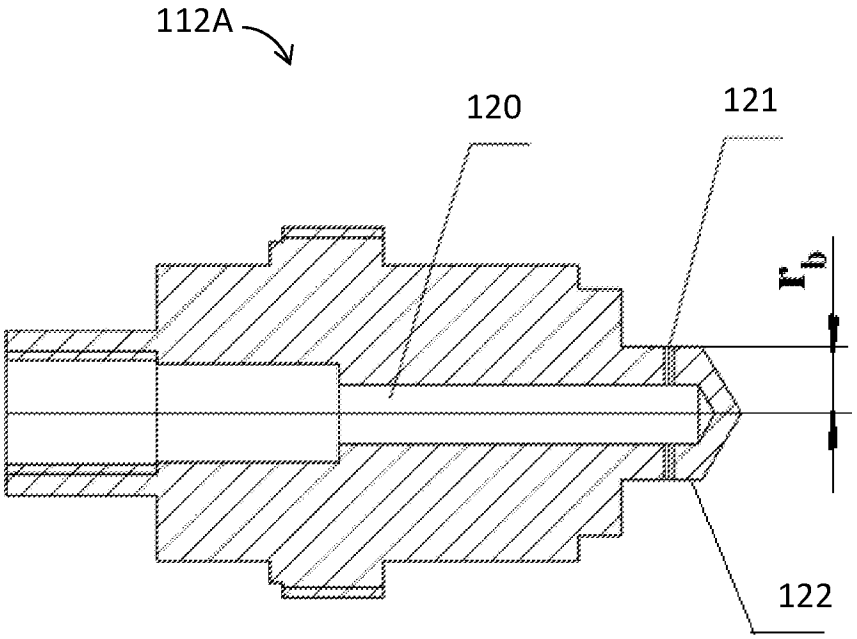

FIGS. 5A and 5B show exemplary cross-sectional drawings of two alternative embodiments of the fuel sleeve, denoted 112A and 112B, together with relevant geometric parameters. In FIG. 112A, fuel tip 122 contains radial orifices 121 through which fuel flows to the secondary vortex chamber 108. In the embodiment of FIG. 5B, fuel nozzles 123 are added in order to prevent clogging under conditions of low fuel flow.

The maximum ratio between tangential and axial components of the air velocity leaving the vortex chambers is determined by the geometric parameters R, $r_n$, $r_t$, $L_n$, $L_t$ of the main vortex chamber 105, as defined in FIGS. 3A and 3B, and by the geometric parameters $R_a$, $r_n^a$, $r_t^a$, $L_n^a$, $L_t^a$ for the secondary vortex chamber 108, as defined in FIGS. 4A and 4B. All of the abovementioned geometric parameters have units of length.

In order to relate the parameters of the main vortex chamber 105 to those of the secondary vortex chamber 108 and of the fuel sleeve 112, it is useful to define three dimensionless parameters—A, $A_a$ and φ—by the equations:

$$A = \frac{R \cdot r_n}{n \cdot r_t^2} \quad \text{(Equation 1)}$$

$$A_a = \frac{R_a \cdot r_n^a}{n(r_t^a)^2} \quad \text{(Equation 2)}$$

$$A_a = \frac{\sqrt{2}}{\varphi\sqrt{\varphi}}(1-\varphi) \quad \text{(Equation 3)}$$

The radius ($r_v$) at which the tangential velocity of the swirling vortex flow reaches its maximum value is then determined by:

$$\frac{r_v^2}{r_n^2} = 1 - \varphi. \quad \text{(Equation 4)}$$

The number (n) of tangential channels 106 (and of tangential orifices 109) appearing in equations 1 and 2, is typically in a range of 4 to 8. The geometric parameters (A) and ($A_a$) determine the ratio of tangential and axial flow velocities in the main and secondary output nozzles; their empirical values are typically in a range of 3 to 6. Equations 1-4 are a consequence of maximizing flow through a cylindrical chamber, for fluid flow in a swirling vortex regime. For any given value of $A_a$, the value of $\varphi$ is found by solving equation 3, and the value of $r_v$ is then found by solving equation 4. Henceforth, the parameter $(1-\varphi)$ will be referred to as a "nozzle threshold parameter".

To optimize the tangential air flow velocity in the main and secondary vortex chambers, and thereby to improve the atomization quality, the atomizer geometric parameters typically satisfy the following relationships:

a) the outlet nozzle length-to-radius ratio, equal to $L_n/r_n$ for the main outlet nozzle and to $L_n^a/r_n^a$ for the secondary outlet nozzle, is in a range of 1 to 2;

b) the tangential length-to-radius ratio, equal to $L_t/r_t$, for the tangential channels 106 of the main vortex channel and equal to $L_t^a/r_t^a$ for the tangential orifices 109 of the secondary vortex channel, is greater than or equal to 1.5;

c) the outlet nozzle transition ratio, equal to $r_f/r_n$ for the main outlet nozzle and to $r_f^a/r_n^a$ for the secondary outlet nozzle, is in a range of 0.2 to 0.3.

d) the ratio of the secondary outlet nozzle outer radius, $r_b^a$, to the main output nozzle radius, $r_n$, is greater than or equal to the square root of the nozzle threshold parameter, $1-\phi$; and e) the ratio of the fuel sleeve outer radius, $r_b$, to the secondary outlet nozzle radius, $r_n^a$, is greater than or equal to the square root of the nozzle threshold parameter, $1-\varphi$.

As a consequence of angular momentum conservation, the tangential velocity of air in the secondary vortex chamber increases with decreasing radius, and reaches its maximum value at a radius equal to the fuel sleeve outer radius, $r_b$. The outflow is confined to an annular ring, limited by the radius $r_n^a$ and the radius at which the pressure is equal to the pressure in the combustion chamber.

The value of the pressure drop on the radial orifices 121 of the fuel sleeve is just large enough to enable fuel to exit from the fuel chamber and enter into the secondary vortex chamber. This permits the radial orifices 121 to be large enough to prevent them from becoming contaminated.

In FIG. 5B, the installation of fuel nozzles 123 into channel 120 causes a decrease in the pressure drop across radial orifices 121, and an increase in the radial orifice diameters at low fuel consumption. It should be noted that the increase in orifice diameter is facilitated by the outflow of fuel into the secondary vortex chamber, where the presence of airflow having a high tangential velocity reduces the flow rate coefficient. The low pressure of the fuel supply at engine startup ensures that the atomizer only requires a single fuel supply pump for both engine startup and for all operational modes, a fact which greatly simplifies engine operation.

Figure 6B:
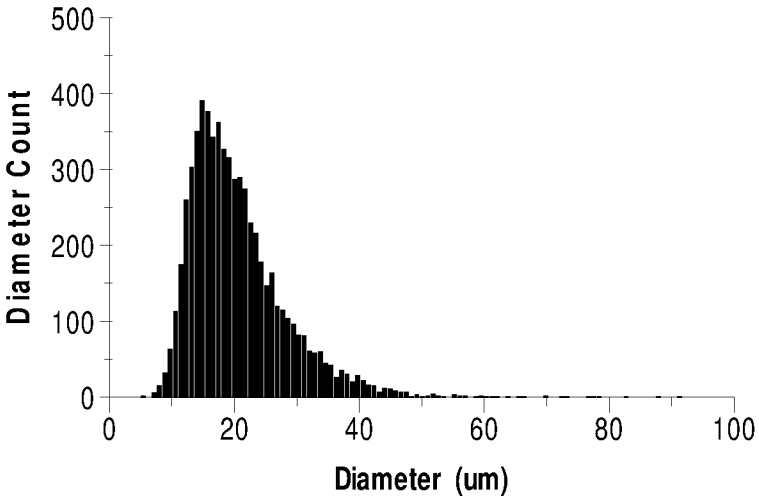
FIG. 6A and FIG. 6B are exemplary histograms of particle diameter distributions for air-water mixtures produced by a prototype atomizer according to the principles of the invention.
Figure 6A:
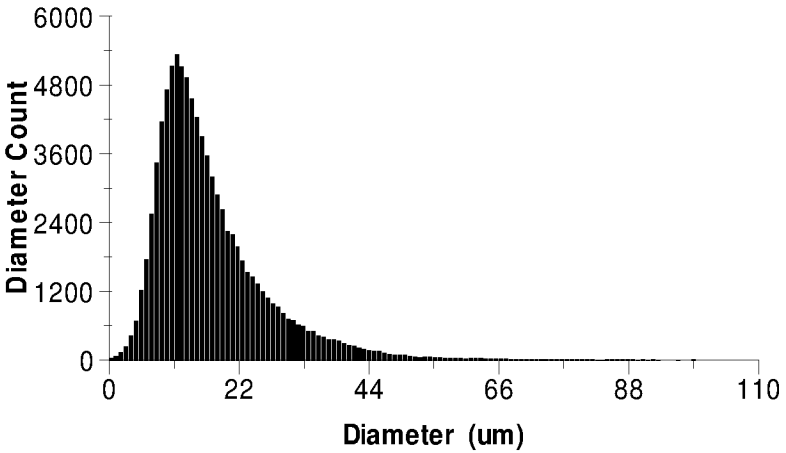

FIG. 6A and FIG. 6B show exemplary histograms of particle diameter distributions of air-fluid mixtures produced in a prototype atomizer constructed according to the principles of the present invention. In the prototype, the fluid used is water instead of fuel. The following table lists the values of the air pressure ($P_{air}$), the air mass flow rate ($m_{air}$), the fluid mass flow rate ($m_f$), and the root-mean-square droplet diameter ($D_{rms}$) corresponding to each of the figures.

TABLE 1

| | $P_{air}$ (bar) | $m_{air}$ (grams/sec) | $m_f$ (grams/sec) | $D_{rms}$ micrometers (μm) |
|---|---|---|---|---|
| FIG. 6A | 0.04 | 6.2 | 4.0 | 29.4 |
| FIG. 6B | 0.06 | 6.1 | 1.2 | 27.6 |

Based upon the results of prototype experiments, the ratio of the air mass flow rate ($m_{air}$) to the fuel mass flow rate ($m_f$) should typically be in a range of 2 to 6. Within this range, the atomizer of the invention provides a high-quality liquid-air mixture in which the diameter of liquid droplets is less than or equal to 30 μm. When the ratio is below 2, the liquid droplets become larger, and their diameters exceed 30 μm. Conversely, when the ratio is above 6, the increase in airflow does not appear to reduce the droplet diameters, or to improve the quality of liquid-air mixture.

It will be appreciated that the above descriptions are intended only to serve as examples, and that many other embodiments are possible within the scope of the present invention as defined in the appended claims. Furthermore, many other configurations of the atomizer, besides the exemplary embodiment explicitly shown in FIG. 2, will be readily apparent to those skilled in the art of gas turbine engines, based upon the principles disclosed herein.

The invention claimed is:

1. An atomizer providing atomization of a fuel-air mixture flowing into a gas turbine engine, the atomizer receiving air input from an engine compressor and fuel input from a low-pressure fuel supply pump, the atomizer comprising an atomizer body, a main vortex chamber comprising a main outlet nozzle in fluid communication with a combustion chamber inlet of the gas turbine engine;

a secondary vortex chamber for improving an atomization quality of the fuel-air-mixture, the secondary vortex chamber comprising a secondary outlet nozzle in fluid communication with the main vortex chamber; and a fuel sleeve providing fuel to the secondary vortex chamber, the fuel sleeve comprising a blind channel with a longitudinal axis and a fuel tip;

wherein, the atomizer further comprises an air cavity and grooves on a surface of the main vortex chamber which supply air to the air cavity.

2. The atomizer of claim 1 further configured to provide an atomized fuel-air mixture to the gas turbine engine, both for engine startup and for all operational modes of the engine.

3. The atomizer of claim 1 wherein the main vortex chamber comprises one or more tangential channels.

4. The atomizer of claim 1 wherein the secondary vortex chamber comprises one or more tangential orifices.

5. The atomizer of claim 1 wherein the fuel sleeve further comprises at least one radial orifice and/or at least one fuel nozzle.

6. The atomizer of claim 1 wherein the secondary vortex chamber and the fuel sleeve are coaxial.

7. The atomizer of claim 1 wherein a position of the main and secondary vortex chambers with respect to the fuel sleeve is fixed by a threaded nut.

8. The atomizer of claim 1 further comprising an airflow tip and/or an air collector.

9. The atomizer of claim 1 wherein a ratio of a mass flow rate of the air input to a mass flow rate of the fuel input has a value in a range of two to six.

10. The atomizer of claim 1 wherein an atomization quality, as determined by a distribution of fuel droplet diameters in the fuel-air mixture, is substantially the same for engine startup and for all operational modes of the engine.

11. The atomizer of claim 1 wherein a ratio of a secondary outlet nozzle outer radius ($r_b^a$) to a main output nozzle radius ($r_n$) is greater than or equal to the square root of a nozzle threshold parameter (1-φ), wherein φ is determined by the relation $$A = \frac{\sqrt{2}}{\varphi\sqrt{\varphi}}(1-\varphi)$$

and A is a dimensionless quantity which depends on geometric parameters of the main vortex chamber.

12. The atomizer of claim 1 wherein a ratio of a fuel sleeve outer radius ($r_b$) to a secondary outlet nozzle radius ($r_n^a$) is greater than or equal to the square root of a nozzle threshold parameter (1-φ), wherein φ is determined by the relation $$A = \frac{\sqrt{2}}{\varphi\sqrt{\varphi}}(1-\varphi)$$

and $A_a$ is a dimensionless quantity which depends on geometric parameters of the secondary vortex chamber.

* * * * *